US005723801A

United States Patent [19]

Hewitt

[11] Patent Number: 5,723,801

[45] Date of Patent: Mar. 3, 1998

[54] DRUM SHELL AND METHOD FOR MAKING SAME

[76] Inventor: Paul Hewitt, 120 Hana Hwy., Unit 9-103, Paia, Hi. 96779

[21] Appl. No.: 260,553

[22] Filed: Jun. 16, 1994

[51] Int. Cl.[6] ..... G10D 13/02

[52] U.S. Cl. ..... 84/411 R

[58] Field of Search ..... 89/411 R, 416, 89/41, 411 A

[56] References Cited

U.S. PATENT DOCUMENTS 4,714,002 12/1987 Cleland ..... 84/416 X 5,280,742 1/1994 Vergara ..... 84/411 R 5,329,837 7/1994 Appolonia, III ..... 84/411 R

*Primary Examiner*—Patrick J. Stanzione

*Attorney, Agent, or Firm*—Benman, Collins & Sawyer

[57] ABSTRACT

A drum shell and method of making same. A first layer of carbon fiber material is rolled into a cylindrical shape. Next, a layer of foam is wrapped over the cylinder of carbon fiber material. Finally, a second layer of carbon fiber material is rolled over the foam layer. In a more specific implementation, several sheets of carbon fiber soaked in an epoxy resin are rolled on a cylindrical mold to provide the first and second rolls thereof. After the application of the second set of sheets, the shell is vacuum dried and cut to desired lengths to complete the construction.

12 Claims, 4 Drawing Sheets

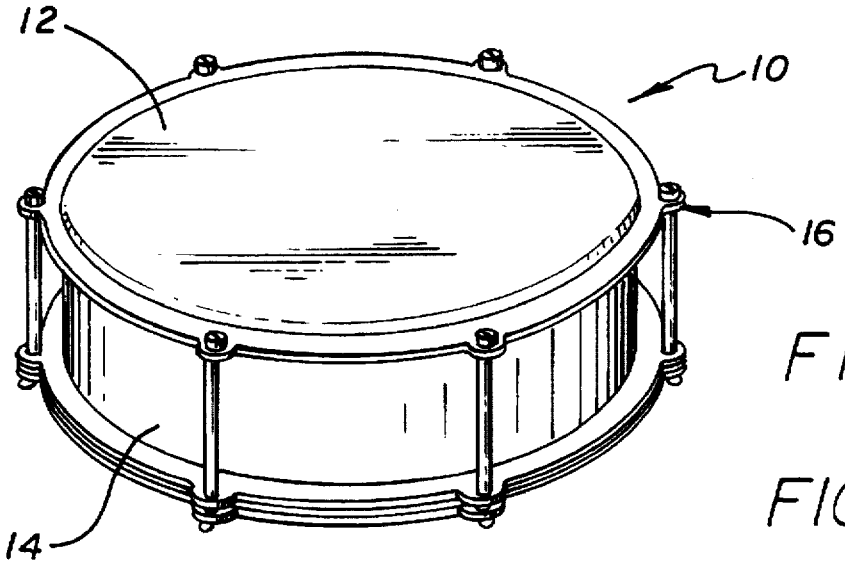
FIG. 1
FIG. 2
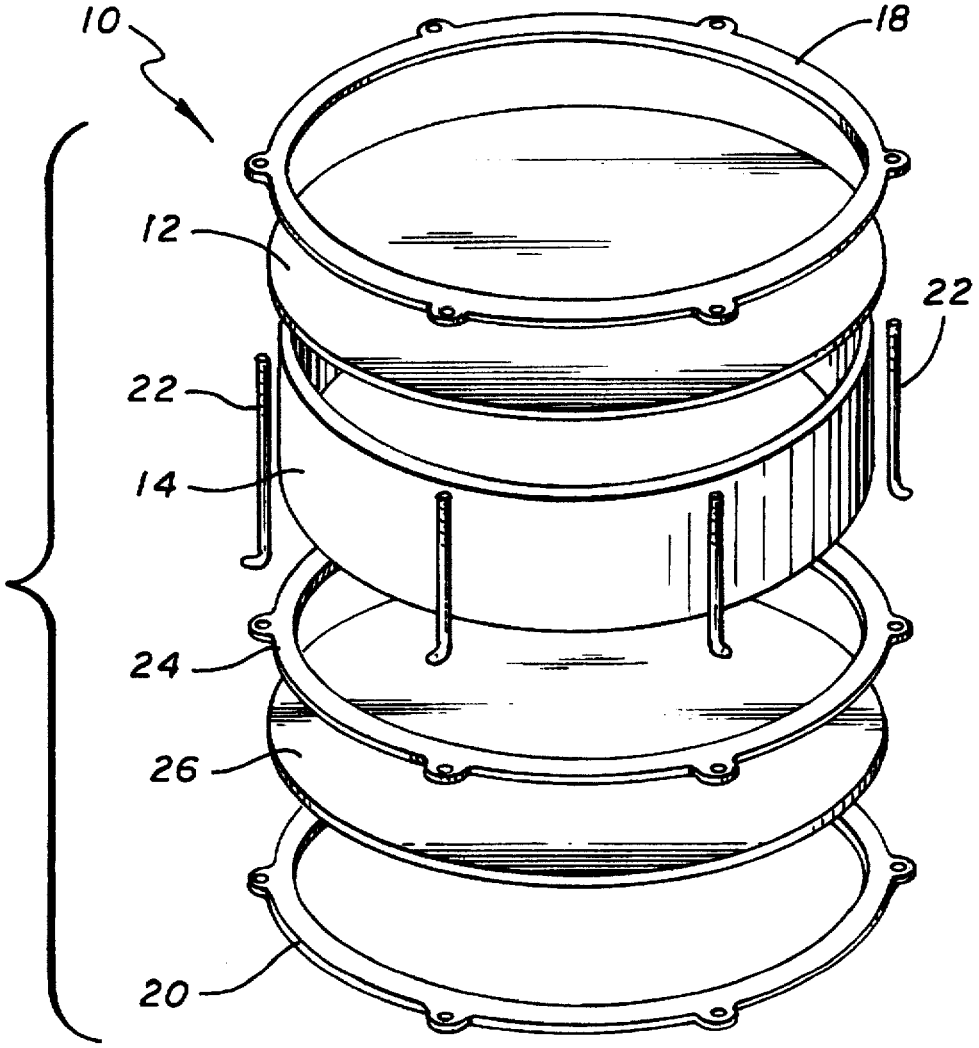

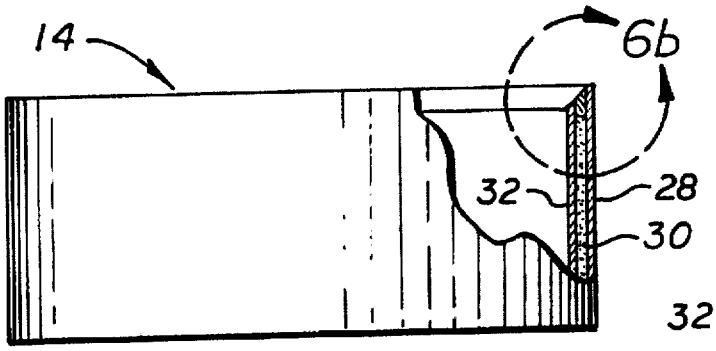
FIG. 4c
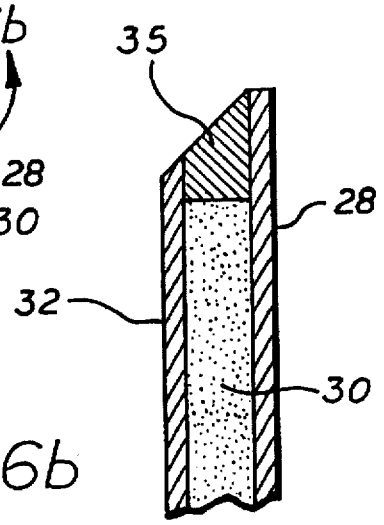
FIG. 6b
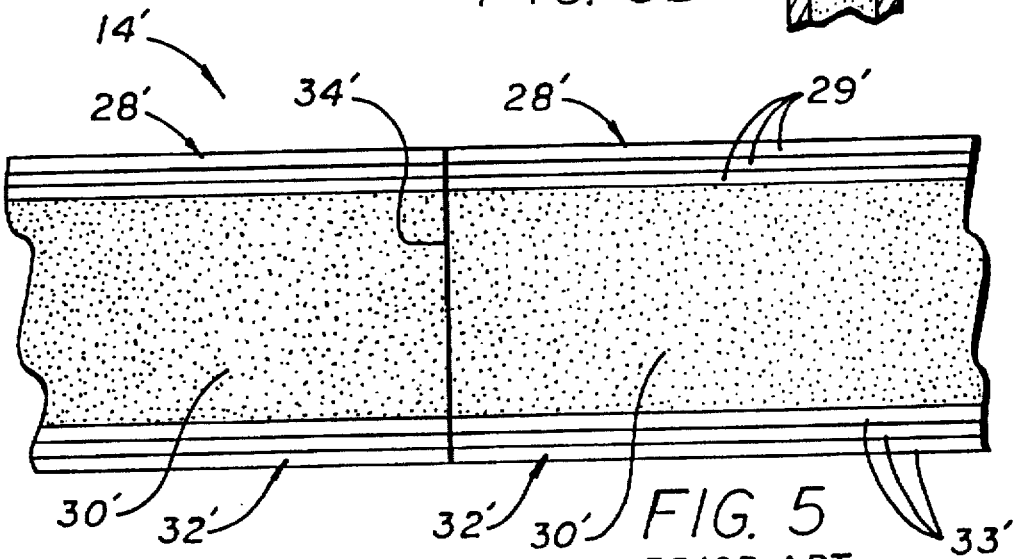
FIG. 5
PRIOR ART
FIG. 6
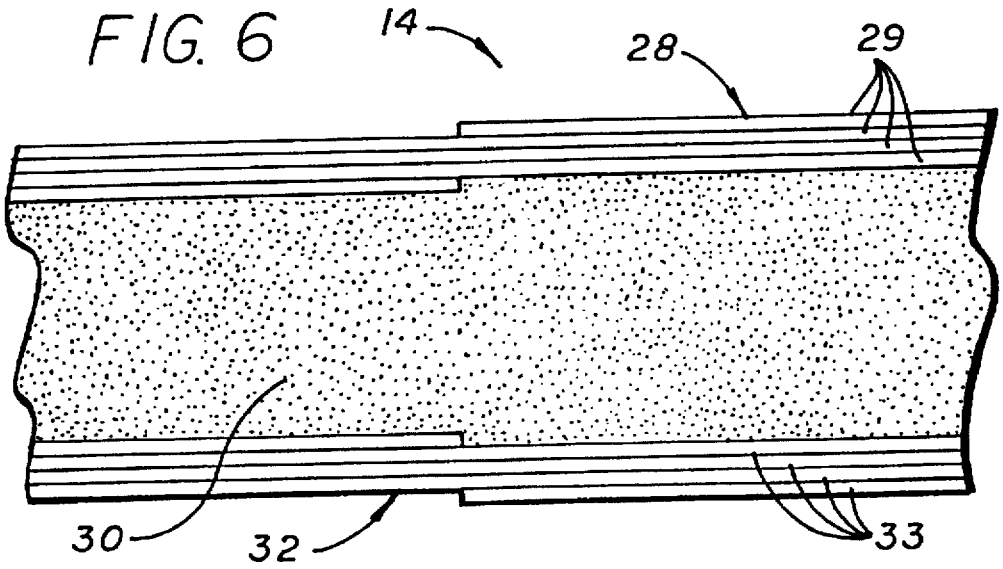

DRUM SHELL AND METHOD FOR MAKING SAME

BACKGROUND OF THE INVENTION

1. Field of the Invention

The present invention relates to musical instruments and the like. More specifically, the present invention relates to drums.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Drum manufacture is a relatively mature art. Conventional drums are of wood or metal. Wooden drums offer a rich sound but have limited sound amplitude or loudness. Metal drums are louder and stronger than wooden drums but suffer in sound quality.

In addition, inasmuch as portability is required for professional drums, the weight of the drum is also a design consideration.

Thus, there is an ongoing need in the art for an improved lightweight drum design which provides a loud, high quality sound which is strong enough to withstand high pressures.

The need in the art was addressed somewhat by U.S. Pat. No. 4,714,002 issued Dec. 22, 1987, to T. P. Cleland et al. and entitled PERCUSSION MUSICAL INSTRUMENT DRUM-HEAD TENSIONING ASSEMBLY AND DRUM SHELL CONSTRUCTION THEREFOR. Cleland et al. disclose a hardware arrangement for stretching a drum skin over a shell made of foam and epoxy impregnated carbon fiber sheets.

As described at column 4, lines 34–38 of the reference, the shell is fabricated by attaching a sheet of carbon fiber to the rigid foam and bending the sheet into a cylindrical female mold. The ends of the sheet are bent together in the mold to form a cylindrical shell.

Unfortunately, the mode of construction of Cleland et al. creates a multi-layer seam in the shell. The seam limits the strength of the shell necessitating a special, perhaps costly, hardware arrangement for stretching the drum-skin thereover. In this regard, two skins are stretched over and under the drum shell but not in contact therewith. Therefore, the skins are acoustically coupled but not mechanically coupled. Hence, certain vibrational modes are not efficiently transmitted from one skin to the other. This limits the loudness of the drum and its resonance which, in turn, impacts the quality of the sound output thereby.

Thus, a need remains in the art for an improved drum construction which offers high quality sound at high amplitude which is lightweight yet strong enough to allow for the use of conventional hardware.

SUMMARY OF THE INVENTION

The need in the art is addressed by the drum shell construction method of the present invention. In accordance with the inventive method, a first layer of carbon fiber material is rolled into a cylindrical shape. Next, a layer of foam is wrapped over the cylinder of carbon fiber material.

Finally, a second layer of carbon fiber material is rolled over the foam layer. In a more specific implementation, several sheets of carbon fiber soaked in an epoxy resin are rolled on a cylindrical mold to provide the first and second rolls thereof. After the application of the second set of sheets, the shell is vacuum dried and cut to desired lengths. The foam layer is recessed and rim material is added to complete the construction.

BRIEF DESCRIPTION OF THE DRAWINGS

FIG. 1 is a perspective view of a drum assembly of utilizing the teachings of the present invention.

FIG. 2 is a perspective view of the drum assembly of FIG. 1 in disassembled relation.

FIG. 4*c* is an illustrative side view of the carbon fiber drum shell constructed in accordance with the teachings of the present invention.

FIG. 5 is a magnified view of a portion of a conventional shell.

FIG. 6*a* is a magnified view of a portion of a drum shell constructed in accordance with the teachings of the present invention.

FIG. 6*b* is a magnified view of a portion of the edge of the drum shell constructed in accordance with the teachings of the present invention.

DESCRIPTION OF THE INVENTION

Figure 3:
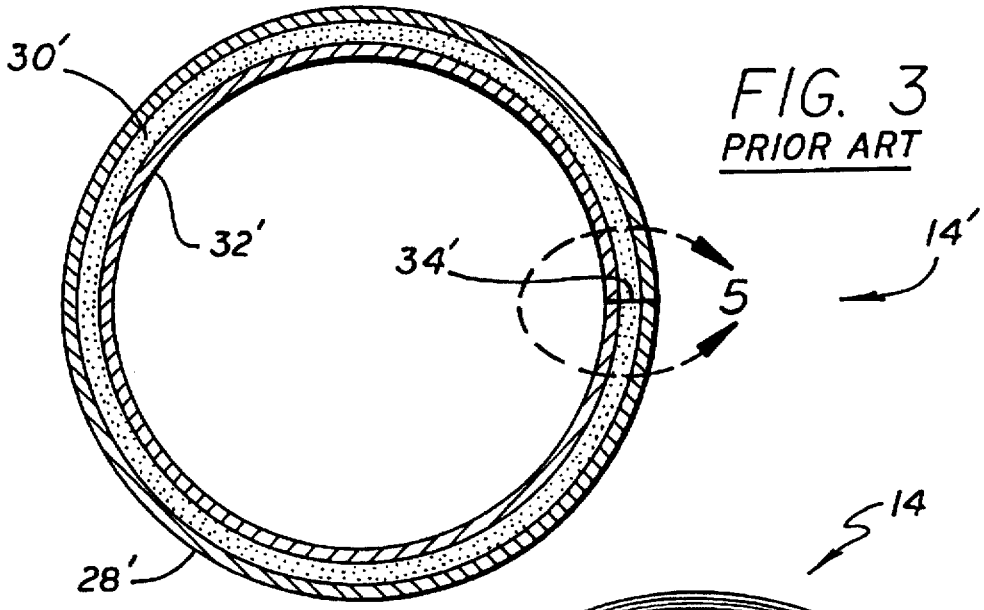
FIG. 3 PRIOR ART
FIG. 3 is a top view of a conventional carbon fiber drum shell showing the seamed laminar construction thereof.

Illustrative embodiments and exemplary applications will now be described with reference to the accompanying drawings to disclose the advantageous teachings of the present invention.

FIG. 1 is a perspective view of a drum assembly of utilizing the teachings of the present invention. FIG. 2 is a perspective view of the drum assembly of FIG. 1 in disassembled relation. The drum assembly 10 includes an upper drum skin 12 secured to a drum shell 14 by a conventional hardware arrangement 16 such as the Pearl free floating hardware set manufactured and sold by Pearl of Nashville, Tenn.

As shown more clearly in FIG. 2, the hardware arrangement 16 includes a first rim 18 which secures the upper drum skin 12 to the shell 14. The upper drum skin may be of conventional construction such as the Power Stroke III drum skin manufactured and sold by the Remo Corporation in Los Angeles, Calif. In accordance with the present teachings, the drum shell 14 has a seamless multi-layer construction of foam and carbon fibers. Those skilled in the art will appreciate that other materials may be used such as Kevlar.

The upper rim 18 is secured to a matching lower rim 20 by a rods 22. The rods 22 extend through holes in the upper rim 18, a hoop 24 and the lower rim 20 to secure the upper skin to the topside of the shell 14 and a lower skin 26 to the bottom side thereof. As is known in the art, the rims 18 are secured by bolts screwed on threaded pins at the ends of the rods 22 to stretch the skins over the shell 14. This creates a secure arrangement which facilitates optimal coupling of acoustic and mechanical energy between the two skins creating a resonance therebetween within the cavity of the shell 14. Thus, a high quality sound may be created at high amplitude.

In accordance with the teachings of the present invention, the quality and amplitude of the acoustic output of the drum assembly is enhanced by the seamless construction thereof.

FIG. 3 is a top view of a conventional carbon fiber drum shell showing the seamed laminar construction thereof. The shell 14' includes a first outer layer of carbon fiber material 28' shown disproportionately large for clarity. A layer of foam material 30' (typically high density polyethylene foam) is sandwiched between the first carbon fiber layer 28' and a second carbon fiber layer 32'. Conventionally, the three layers are created on a flat surface and then forced into a female mold so that the ends thereof abut to form a seam 34'.

As mentioned above, the seam 34' provides a weakness in the structure limiting the extent to which the shell may be stressed. This, in turn, limits the extent to which a skin may be stretched over the shell. Thus, a special hardware arrangement must be provided such as that shown in the above-referenced U.S. Pat. No. 4,714,002 issued Dec. 22, 1987, to T. P. Cleland et al. and entitled PERCUSSION MUSICAL INSTRUMENT DRUM-HEAD TENSIONING ASSEMBLY AND DRUM SHELL CONSTRUCTION THEREFOR, the teachings of which are incorporated herein by reference.

Figure 4A:
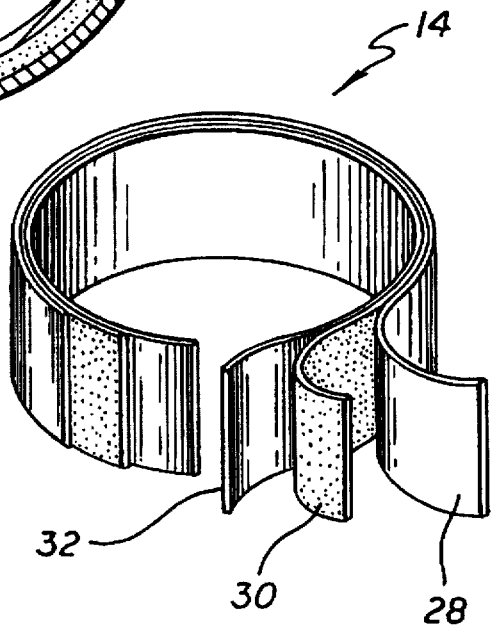
FIG. 4*a* is a perspective view of a carbon fiber drum shell constructed in accordance with the teachings of the present invention.

FIG. 4*a* is a perspective view of a carbon fiber drum shell constructed in accordance with the teachings of the present invention. First and second carbon fiber layers 28 and 32 sandwich a foam layer 30 without creating a seam. The seamless construction results from the drum shell fabrication method of the present invention as discussed more fully below.

Figure 4B:
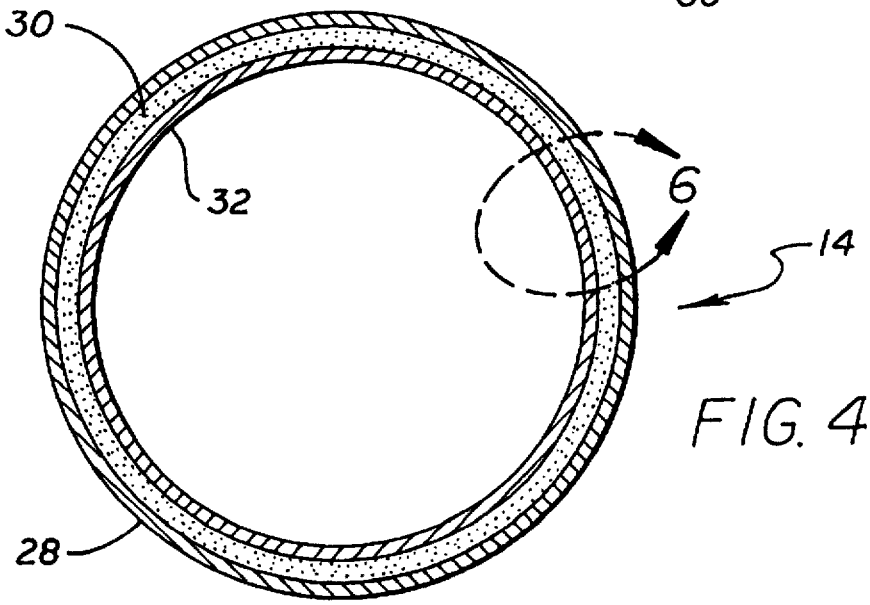
FIG. 4*b* is an illustrative top view of the carbon fiber drum shell constructed in accordance with the teachings of the present invention.

FIG. 4*b* is an illustrative top view of the carbon fiber drum shell constructed in accordance with the teachings of the present invention.

FIG. 4*c* is an illustrative side view of the carbon fiber drum shell constructed in accordance with the teachings of the present invention.

FIG. 5 is a magnified view of a portion of a conventional shell. As shown in FIG. 5, the first carbon fiber layer 28' includes a plurality of individual sheets of carbon fiber material 29' overlaid to create a laminar construction. Likewise, the second carbon fiber layer 32' consists of a number of sheets of carbon fiber material overlaid to create a laminar construction. As mentioned above, the individual sheets of carbon fiber material and the layer of foam are overlaid and cut such that the ends are even. Then the combined layers are forced into a mold so that the ends abut to form the seam 34'. The limitations of this seamed construction are discussed above.

FIG. 6*a* is a magnified view of a portion of a drum shell constructed in accordance with the teachings of the present invention. Each sheet of carbon fiber material 29, 33 is applied to create a roll type of construction.

FIG. 6*b* is a magnified view of a portion of the edge of the drum shell constructed in accordance with the teachings of the present invention as depicted in FIG. 4*c*. As shown in FIG. 6*b*, a portion of the foam layer 30 is removed by a suitable tool. Next, the space provided by the removal of the foam is filled with liquid graphite material such as graphite powder mixed with epoxy. When the liquid graphite material hardens, a rim 35 is provided on each edge of the shell 14. The rim 35 is shaped on the machine discussed below. The rims 35 couple the inner and outer layers and add to the acoustic transfer between the upper and lower heads.

Figure 7:
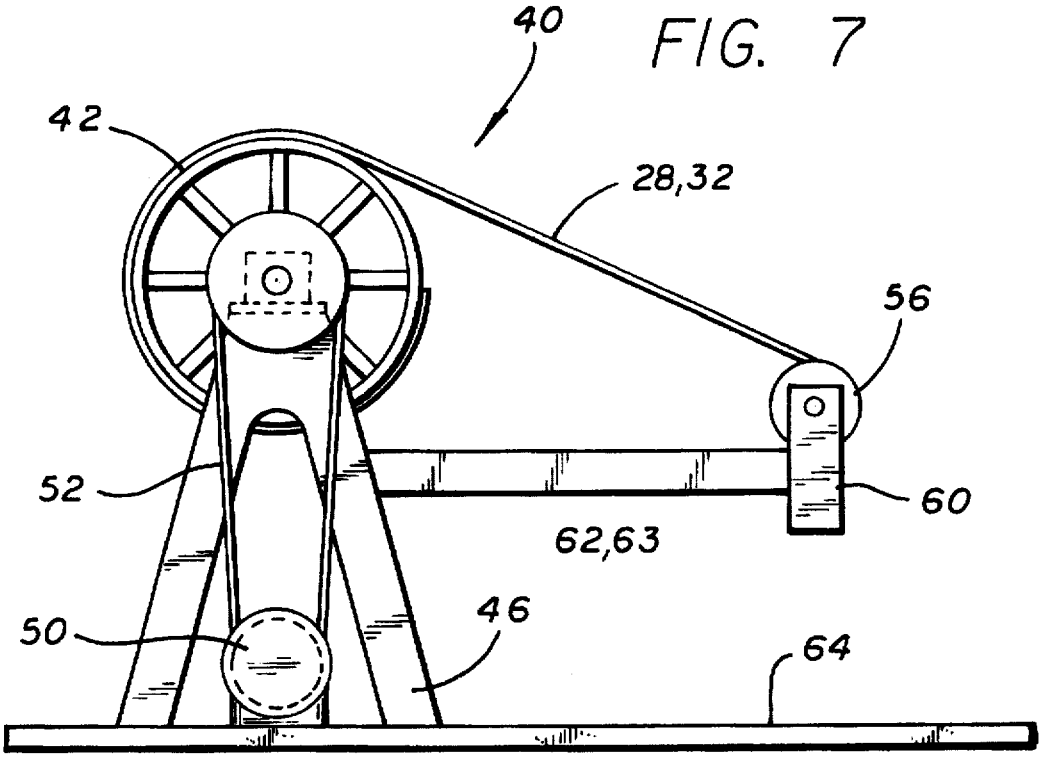
FIG. 7 is a side view of a machine for fabricating drum shells in accordance with the teachings of the present invention.
Figure 8:
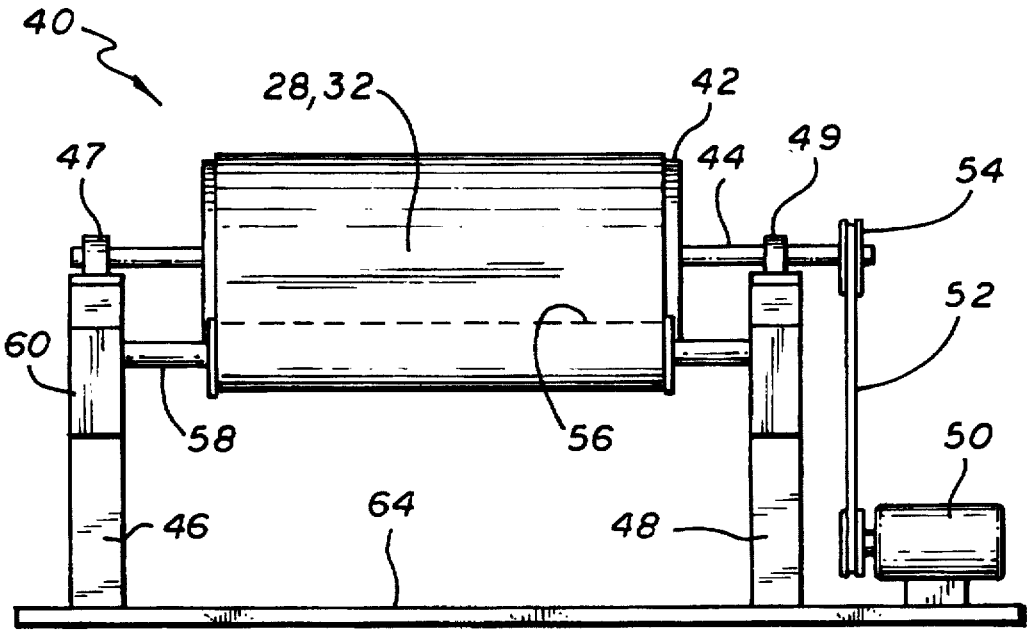
FIG. 8 is a front view of the machine of FIG. 7.

FIG. 7 is a side view of a machine for fabricating drum shells in accordance with the teachings of the present invention. FIG. 8 is a front view of the machine of FIG. 7. As illustrated in FIGS. 7 and 8, the machine 40 includes a removable mandrel 42 which is supported on a rod 44. The mandrel may be constructed of wood, metal, fiberglass or other suitable material. The mandrel 42 and rod 44 are supported on each end by A-shaped frame structures 46 and 48. The rod is retained on top of the A-shaped structures by first and second clamps 47 and 49. The rod 44 is driven by a conventional variable speed motor 50 via a belt 52 and a drive wheel 54. As the mandrel 42 turns, material is drawn from a spool 56 mounted on a spool support 60. The spool support 60 is detachably mounted on arms 62 and 63 which extend from the A-shaped supports 46 and 48 respectively.

In accordance with the inventive method, the drum shell is constructed by drawing carbon fiber material from the spool 56 at low speed to create a multilayer structure. The layers are bonded layer-to-layer by a conventional epoxy resin. Next, a sheet of high density foam is wrapped around the multi-layer carbon fiber roll. Multiple additional layers of carbon fiber with epoxy are applied to the desired thickness. The composite structure is dried in a vacuum to remove air bubbles. Finally, the motor 50 is driven at high speed while the dried composite structure is cut to desired lengths. This completes the fabrication of the shelled structures.

Next, as mentioned above, foam is removed from the edges of the shells to create a circular channel therein. The channel is filled with a graphite/epoxy mix for additional stiffness. The shell may then be painted as desired before the drum skins and conventional hardware are applied to complete the drum construction.

Female molds are ordinarily used to control the outer surface of the drum. However, in accordance with the present teachings, the machine 40 provides a system by which the shell 14 can be turned at high speed. Layers are added and cut to achieve a perfectly round, smooth shell. Also, the rims 35 are fabricated to near perfect symmetry.

Thus, the present invention has been described herein with reference to a particular embodiment for a particular application. Those having ordinary skill in the art and access to the present teachings will recognize additional modifications applications and embodiments within the scope thereof. For example, the invention is not limited to the manufacture of drum shells. The invention may be applied to the construction of other types of cylinders constructed with multiple layers of flexible material.

It is therefore intended by the appended claims to cover any and all such applications, modifications and embodiments within the scope of the present invention.

Accordingly,

What is claimed is:

1. A seamless drum shell comprising:

a first seamless roll of carbon fiber;

a layer of foam disposed on said first roll of carbon fiber;

a second seamless roll of carbon fiber disposed on said layer of foam.

2. The invention of claim 1 including a graphite/epoxy rim on said drum shell.

3. A method of constructing a seamless drum shell including the steps of:

rolling a first layer of carbon fiber material into a first seamless cylinder;

wrapping a layer of foam over said first cylinder; and rolling a second layer of carbon fiber material over said foam to provide said seamless drum shell.

4. The invention of claim 3 including the step of rolling said first layer of carbon fiber material over a cylindrical mold.

5. The invention of claim 4 including the step of providing an epoxy to said carbon fiber layers.

6. The invention of claim 5 including the step of vacuum drying said shell.

7. The invention of claim 6 including the step of removing foam peripherally from said shell to provide a cylindrical channel therein.

8. The invention of claim 7 including the step of adding a liquid graphite/epoxy filling in said cylindrical channel to provide a rim on said shell.

9. The invention of claim 8 including the step of sanding and shaping rims of said shell while spinning and finishing same.

10. A seamless drum shell fabricated in accordance with the following process:

rolling a first layer of material over a cylindrical mold into a first seamless cylinder;

wrapping a layer of foam over said first cylinder; and rolling a second layer of material over said foam to provide said seamless drum shell.

11. The invention of claim 10 wherein said material is Kevlar.

12. The invention of claim 11 wherein said material is carbon fiber.

* * * * *